US006217680B1

(12) United States Patent
Kawabata et al.

(10) Patent No.: US 6,217,680 B1
(45) Date of Patent: Apr. 17, 2001

(54) THICK COLD ROLLED STEEL SHEET EXCELLENT IN DEEP DRAWABILITY AND METHOD OF MANUFACTURING THE SAME

(75) Inventors: Yoshikazu Kawabata; Kaneharu Okuda; Kei Sakata; Takashi Obara; Atsushi Ogino, all of Chiba (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/254,871

(22) PCT Filed: Aug. 3, 1998

(86) PCT No.: PCT/JP98/03443

§ 371 Date: Mar. 15, 1999

§ 102(e) Date: Mar. 15, 1999

(87) PCT Pub. No.: WO99/07907

PCT Pub. Date: Feb. 18, 1999

(30) Foreign Application Priority Data

Aug. 5, 1997 (JP) ..... 9-210533

(51) Int. Cl.[7] ..... C21D 8/04
(52) U.S. Cl. ..... 148/651; 148/653
(58) Field of Search ..... 148/651, 652, 148/653

(56) References Cited

U.S. PATENT DOCUMENTS 4,504,326 * 3/1985 Tokunaga et al. ..... 148/653
5,041,166 * 8/1991 Matsuoka et al. ..... 148/651
5,360,493 * 11/1994 Matsuoka et al. ..... 148/651
5,587,027 * 12/1996 Tosaka et al. ..... 148/651
5,846,343 * 12/1998 Yasuhara et al. ..... 148/651
5,855,696 * 1/1999 Tezuka et al. ..... 148/651

FOREIGN PATENT DOCUMENTS 61-119621 6/1986 (JP) .
63-100134 * 5/1988 (JP) .
63-230828 * 9/1988 (JP) .
3-150916 6/1991 (JP) .
3-150316 * 6/1991 (JP) .

* cited by examiner

*Primary Examiner*—George Wyszomierski
(74) *Attorney, Agent, or Firm*—Oliff & Berridge, PLC

(57) ABSTRACT

A steel slab having a composition that comprises at most 0.008% by weight of C, at most 0.5% by weight of Si, at most 1.0% by weight of Mn, at most 0.15% by weight of P, at most 0.02% by weight of S, from 0.01 to 0.10% by weight of Al, at most 0.008% by weight of N, from 0.035 to 0.20% by weight of Ti, and from 0.001 to 0.015% by weight of Nb, with a balance of Fe and inevitable impurities, in which those C, S, N, Ti and Nb satisfy the following condition:

$$1.2(C/12+N/14+S/32)<(Ti/48+Nb/93),$$

is subjected to rough hot-rolling to a reduction ratio of not lower than 85%, at a temperature falling between the $Ar_3$ transformation point of the steel and 950° C., then to finishing hot-rolling to a reduction ratio of not lower than 65%, at a temperature falling between. 600° C. and the $Ar_3$ transformation point of the steel, while being lubricated, to thereby have a mean shear strain of not larger than 0.06, then pickled, pre-annealed at a temperature falling between 700 and 920° C., cold-rolled to a reduction ratio of not lower than 65%, and thereafter further annealed for recrystallization at a temperature falling between 700 and 920° C.

12 Claims, 4 Drawing Sheets

THICK COLD ROLLED STEEL SHEET EXCELLENT IN DEEP DRAWABILITY AND METHOD OF MANUFACTURING THE SAME

DESCRIPTION

1. Technical Field

The present invention relates to cold-rolled sheet steel favorable to use for compressor covers, oil pans for vehicles and others, in particular, to that with good deep drawability having a thickness of not smaller than 1.2 mm, and also to a method for producing it.

2. Background Art

Many parts of compressor covers, oil pans for vehicles and others are produced through deep drawing of thick sheet steel, and sheet steel for those applications is desired to have a high r value. Thick sheet steel having a thickness of not smaller than 1.2 mm and having an r value of about 2.0 is produced in an ordinary hot rolling-cold rolling process. The amount of sheet steel to be shaped into articles is increasing, and steel articles are desired to have complicated shapes, for which sheet steel is desired to have a much higher r value.

For producing cold-rolled sheet steel having a high r value, known is a method comprising hot-rolling steel under a lubricative condition at a finishing delivery temperature falling within a range not higher than the $Ar_3$ transformation point of the steel (lubricative warm-rolling), for example, as in Japanese Patent Application Laid-Open (JP-A) Sho-61-119621, Hei-3-150316, etc. In JP-A Hei-3-150916, they say that the sheet steel produced has an r value of about 2.9.

However, in order to obtain sheet steel having such a high r value according to the known method, steel must be subjected to lubricative warm-rolling to a reduction ratio of higher than 90%, and then to cold rolling to a reduction ratio of 75% or higher. For example, in the method disclosed in JP-A Sho-61-119621, where steel is subjected to lubricative warm-rolling to a reduction ratio of not higher than 90% and then to cold rolling to a reduction ratio of lower than 75%, the r value of the resulting sheet steel could be at most about 2.0.

This is because, in the process of rolling steel through lubricative warm-rolling followed by cold rolling to such a low reduction ratio, the steel could not satisfactorily get the effect of lubricative warm-rolling. Therefore, in the prior art, it was extremely difficult to increase the r value of cold-rolled thick sheet steel, for which the reduction ratio could not be lowered to a satisfactory degree.

Specifically, in the conventional rolling process, the thickness of the slab to be rolled must be at most about 200 mm or so, and the reduction ratio in the rough hot-rolling step must be at least 85% in order that the steel grains could be sufficiently fined in the lubricative warm-rolling step prior to the final rolling step for finishing. For these reasons, therefore, in the actual production line for the conventional rolling process, the thickness of the sheet bar to be rolled shall be at most about 30 mm or so. In continuous rolling in which one sheet bar is joined to another, the thickness of the sheet bars to be rolled shall be at most about 30 mm or so in view of the coiling ability of the sheet bar coiler to be used therein.

As mentioned above, the thickness of the sheet bars capable of being rolled in the conventional process could be at most about 30 mm or so. Therefore, according to the conventional rolling process, it is extremely difficult to obtain cold-rolled sheet steel having a thickness of not smaller than 1.2 mm, while satisfying the combination of the reduction ratio in the lubricative warm-rolling step of being not lower than 90% and the reduction ratio in the cold rolling step of being not lower than 75%. Even if the reduction ratio in the lubricative warm-rolling step could be at most 86% and that in the cold rolling step be at most 75% under various conditions, the r value of the actually rolled sheets could be at most about 2.6 or so.

Given that situation, one object of the present invention is to provide cold-rolled thick sheet steel having a thickness of not smaller than 1.2 mm and having an r value of not lower than 2.9.

Another object of the invention is to provide a practicable method for producing cold-rolled thick sheet steel having a thickness of not smaller than 1.2 mm and having an r value of not lower than 2.9.

DISCLOSURE OF THE INVENTION

Despite of the problems noted above, we, the present inventors still believed that the combination of lubricative warm rolling and cold rolling would be the best for producing the intended, thick cold-rolled sheet steel, in view of its effect for improving the mechanical properties of the sheet steel produced and from the economical viewpoint of it. In that situation, we have assiduously studied in order to solve the problems in the prior art noted above and to obtain good, thick cold-rolled sheet steel, and, as a result, have completed the present invention. The constitution of the invention is described hereinunder.

Specifically, the invention provides the following:

(1) Thick cold-rolled sheet steel with excellent deep drawability, which has a thickness of not smaller than 1.2 mm and has an r value to be defined by the following equation (1) of not smaller than 2.9:

$$r=(r_0+2r_{45}+r_{90})/4 \quad (1)$$

wherein $r_0$, $r_{45}$ and $r_{90}$ each indicate the Lankford value of the sheet steel in the rolling direction, in the direction at an angle of 45° relative to the rolling direction, and in the direction at an angle of 90° relative to the rolling direction, respectively.

(2) A method for producing thick cold-rolled sheet steel from a steel slab having a composition that comprises at most 0.008% by weight of C, at most 0.5% by weight of Si, at most 1.0% by weight of Mn, at most 0.15% by weight of P, at most 0.02% by weight of S, from 0.01 to 0.10% by weight of Al, at most 0.008% by weight of N, from 0.035 to 0.20% by weight of Ti, and from 0.001 to 0.015% by weight of Nb, with a balance of Fe and inevitable impurities, in which those C, S, N, Ti and Nb satisfy the following condition (2):

$$1.2(C/12+N/14+S/32)<(Ti/48+Nb/93) \quad (2),$$

the method comprising subjecting said steel slab to rough hot-rolling to a reduction ratio of not lower than 85%, at a temperature falling between the $Ar_3$ transformation point of the steel and 950° C., then subjecting it to lubricative warm-rolling for finishing hot-rolling to a reduction ratio of not lower than 65%, at a temperature falling between 600° C. and the $Ar_3$ transformation point of the steel, while lubricating it, to thereby make it have a mean shear strain of not larger than 0.06, then pickling it, pre-annealing it at a temperature falling between 700 and 920° C., cold-rolling it to a reduction ratio of not lower than 65%, and thereafter further annealing it for recrystallization at a temperature falling between 700 and 920° C.

(3) The method for producing thick cold-rolled sheet steel as in (2), wherein the thickness of the hot-rolled sheet after the finishing hot-rolling step is not smaller than 5 mm.

(4) The method for producing thick cold-rolled sheet steel as in (2) or (3), wherein the steel composition additionally contains B in an amount of from 0.0001 to 0.01% by weight.

(5) The method for producing thick cold-rolled sheet steel as in any one of (2) to (4), wherein the steel composition additionally contains any one or more of from 0.001 to 0.05% by weight of Sb, from 0.001 to 0.05% by weight of Bi and from 0.001 to 0.05% by weight of Se.

(6) The method for producing thick cold-rolled sheet steel as in (2), wherein the reduction ratio for the sheet in the lubricative warm-rolling step to be effected at a temperature falling between 600° C. and the $Ar_3$ transformation point of the steel is lower than 85% when the reduction ratio for the cold-rolled sheet is lower than 96.6% relative to the sheet bar.

BEST MODES OF CARRYING OUT THE INVENTION

The experiments and their data, on the basis of which the inventors have achieved the invention, are described below.

It is known that, in ordinary warm-rolling, a shear strain layer is formed in the surface part of sheet steel whereby the r value of the sheet steel is lowered. Therefore, in order to prevent the growth of the shear strain layer, it will be effective to roll steel slabs while lubricating them. On the other hand, however, in such lubricative rolling, the friction force for leading sheet steel into rolls is lowered. Therefore, it is difficult to completely remove the shear strain layer from rolled sheet steel by such lubrication only. In particular, for thick cold-rolled sheet steel to which the invention is directed, the reduction ratio in lubricative warm rolling and in cold rolling could not be lowered to a satisfactory degree, and it is considered that such thick cold-rolled sheet steel will be greatly influenced by the shear strain of itself to thereby have a lowered r value.

Figure 1:
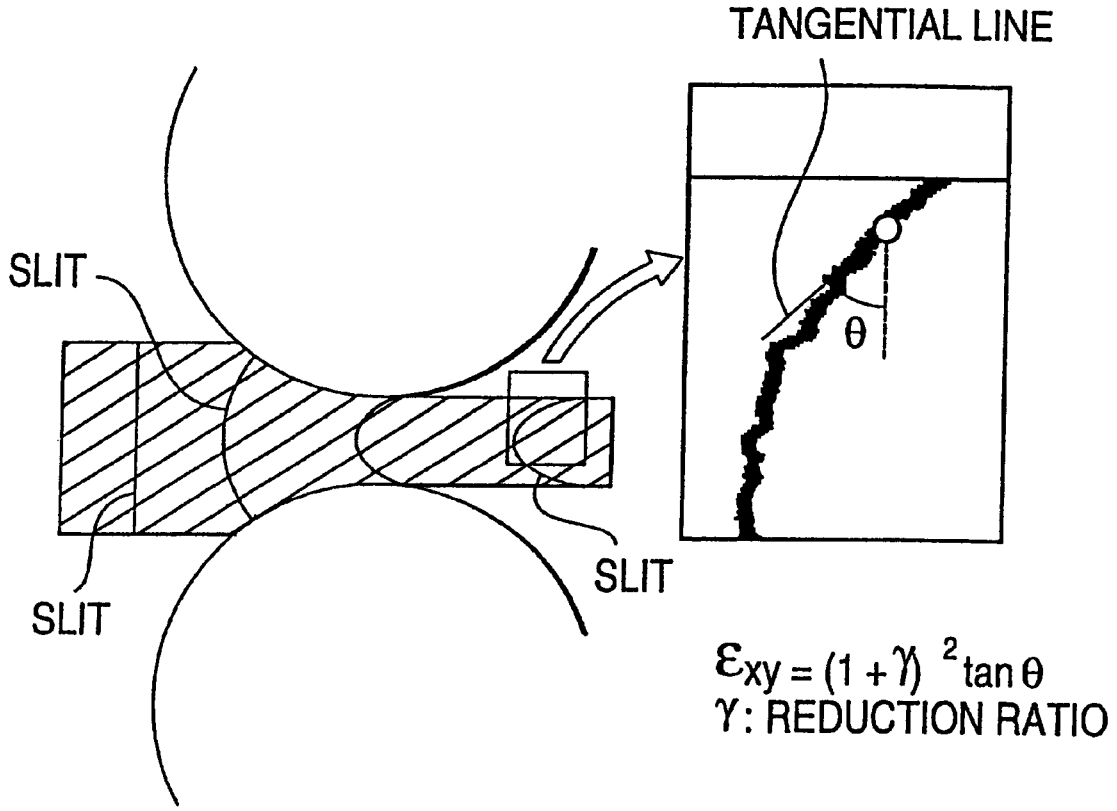
FIG. 1 is a view showing a method for measuring the shear strain of sheet steel.

In that situation, we, the present inventors have variously studied to find out a method for reducing the influence of the shear strain of warm-rolled sheet steel on the step of cold-rolling the sheet steel. FIG. 1 shows a method for measuring the shear strain of sheet steel. As in FIG. 1, a slit was formed in a sheet steel sample in the direction vertical to the rolling direction, and from the degree of inclination, θ, of the slit in the rolled sample, obtained was the shear strain, $(1+r)^2\tan\theta$, in which r indicates the reduction ratio. In that manner, the shear strain was measured at 50 points at regular intervals in the direction of the thickness of the sheet sample, and the data measured were averaged in the thickness direction to obtain the mean shear strain.

Figure 2:
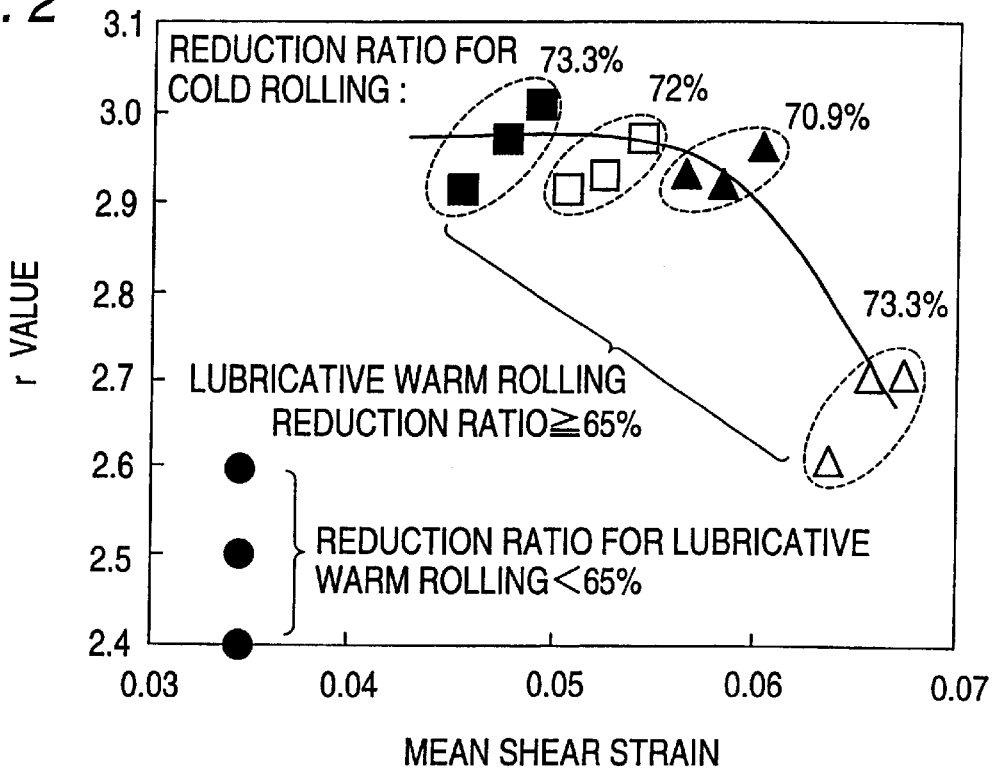
FIG. 2 is a graph showing the influence of the mean shear strain of finishing hot-rolled sheet steel on the r value of the cold-rolled sheet steel.
Figure 3:
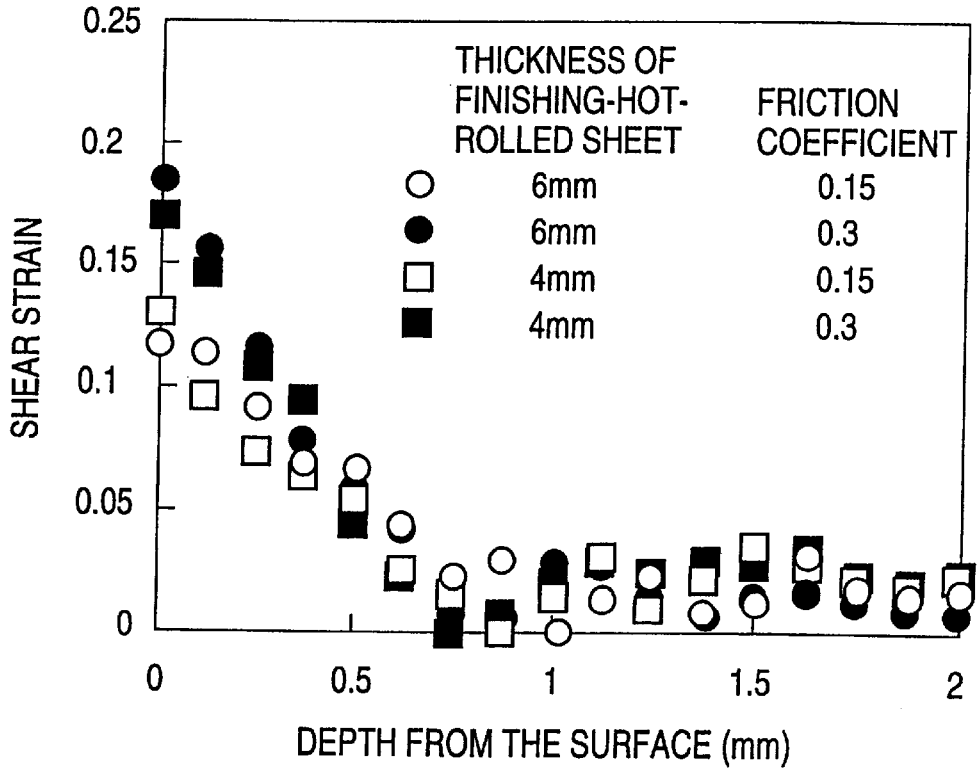
FIG. 3 is a graph showing the shear strain of lubricative warm-rolled sheet steel that varies in the direction of the thickness of the sheet steel.

FIG. 2 to FIG. 5 show the data which we obtained in our experiments. FIG. 2 is a graph showing the influence of the mean shear strain of lubricative warm-rolled sheet steel and the reduction ratio for the sheet steel, on the r value of the cold-rolled sheet steel. From FIG. 2, it is known that when the reduction ratio in the lubricative warm-rolling step is not lower than 65% and when the mean shear strain of the lubricative warm-rolled sheet steel is not larger than 0.06, then the r value of the cold-rolled sheet steel is significantly increased. FIG. 3 is a graph showing the shear strain of the lubricative warm-rolled sheet steel that varies in the direction of the thickness of the sheet steel. As in FIG. 3, it is known that the shear strain is concentrated within the region of about 0.5 mm from the surface layer, irrespective of the thickness of the finishing hot-rolled sheet steel, and that the mean shear strain of the hot-rolled sheet steel could be reduced if the sheet steel could be controlled to have a suitably large thickness.

Figure 4:
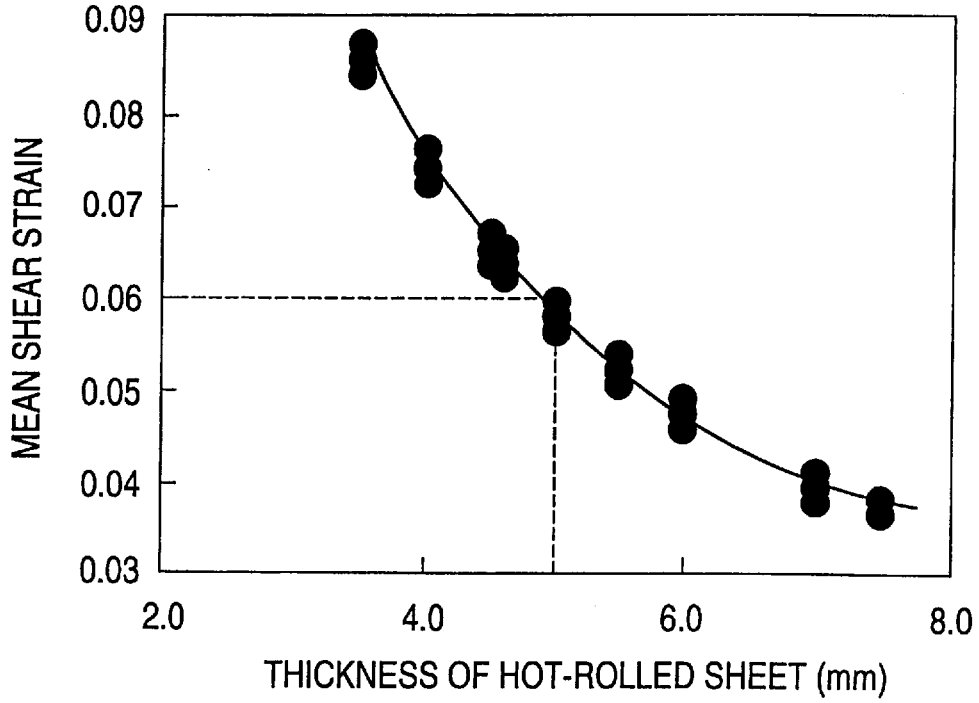
FIG. 4 is a graph showing the relationship between the mean shear strain of finishing hot-rolled sheet steel and the thickness thereof (thickness of hot-rolled sheet steel).
Figure 5:
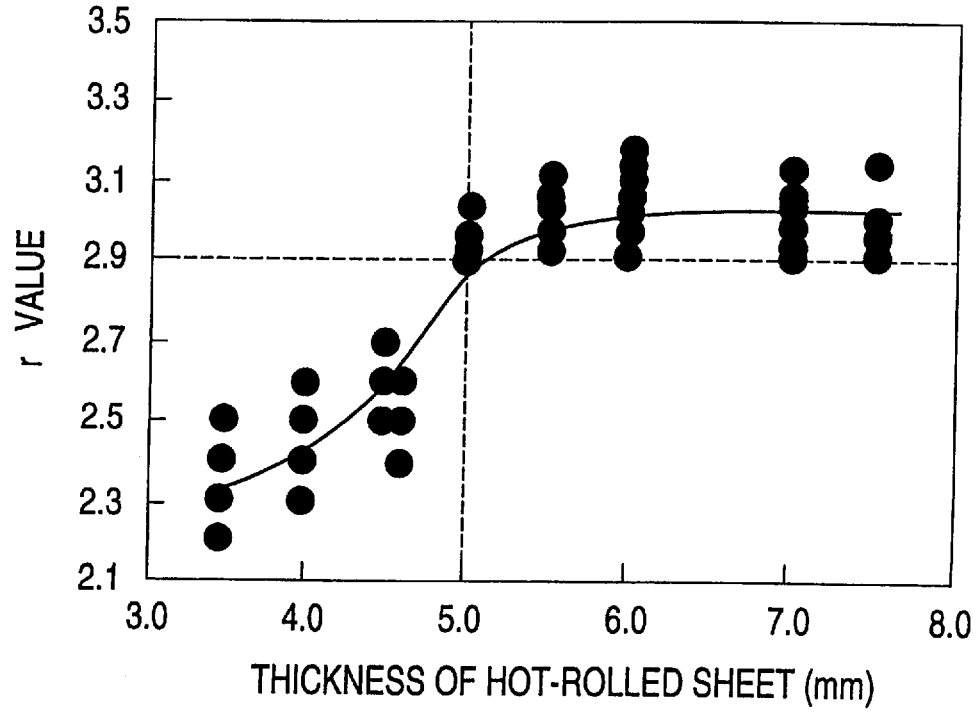
FIG. 5 is a graph showing the influence of the thickness of finishing hot-rolled sheet steel (thickness of hot-rolled sheet steel) on the r value of the cold-rolled sheet steel.

In fact, it was found that, when the thickness of the finishing hot-rolled sheet steel was not smaller than 5 mm, then the mean shear strain of the sheet steel was reduced to be not larger than 0.06, as in FIG. 4, and the r value of the cold-rolled sheet steel was increased to be not smaller than 2.9, as in FIG. 5.

In FIG. 2, plotted were the data of samples Nos. 2, 3, 12, 19, 20, 24, 25, 34, 41, 42, 46, 47, 56, 63 and 64 (for these, the reduction ratio in the lubricative warm-rolling step was not lower than 65%) and those of samples Nos. 52, 60 and 66, from the data shown in Table 2 and Table 3 to be mentioned in the following Examples. In FIG. 3, plotted were the data of shear strain various lubricative warm-rolled sheet steel samples. Precisely, various sheet steel samples were subjected to lubricative warm-rolling in a laboratory, for which the rolling temperature was 700° C., the reduction ratio was 40% and the friction coefficient was varied to fall between 0.15 and 0.3, into rolled sheets having different thicknesses, and the shear strain of each rolled sheet sample was measured at predetermined sites varying in the direction of the thickness of the sample. In FIG. 4 and FIG. 5, plotted were the data of the samples in Table 2 and Table 3 in the following Examples, for which the reduction ratio in the lubricative warm-rolling step was not lower than 65% and the reduction ratio in the cold-rolling step was not lower than 65%. These FIG. 4 and FIG. 5 indicate the influence of the thickness of the finishing hot-rolled sheet steel on the mean shear strain of the sheet steel and on the r value of the cold-rolled sheet steel, respectively.

The reasons for the requirements defined herein are described below.

(1) Thickness and r Value of Sheet Steel:

Sheet steel capable of being produced in the prior art to have a thickness of 1.2 mm or more could have an r value of at most 2.6, and its drawability is not always satisfactory. The object of the present invention is to provide thick cold-rolled sheet steel having a thickness of not smaller than 1.2 mm and having an r value of 2.9 or more. In this connection, on the prior art level, the r value of 2.9 is the highest for sheet steel having a thickness of smaller than 1.2 mm.

The r value is represented by the following equation:

$$r=(r_0+2r_{45}+r_{90})/4 \quad (1)$$

wherein $r_0$, $r_{45}$ and $r_{90}$ each indicate the Lankford value of sheet steel in the rolling direction, in the direction at an angle of 45° relative to the rolling direction, and in the direction at an angle of 90° relative to the rolling direction, respectively.

(2) Steel Composition:

C: not larger than 0.008% by weight.

More desirably, C is as smaller as possible for better deep drawability of sheet steel. C in steel in an amount of not larger than 0.008% by weight would not have any significant negative influences on the workability of the steel. Therefore, the C content of steel in the invention is defined to be not larger than 0.008% by weight, but preferably not larger than 0.002% by weight.

Si: not larger than 0.5% by weight.

Si acts to reinforce steel, and a necessary amount of Si is added to steel in accordance with the intended strength of the steel. However, adding too much Si to steel in an amount of larger than 0.5% by weight will have some negative influences on the deep drawability of the steel. Therefore, the amount of Si to be in the steel of the invention is defined to be not larger than 0.5% by weight, but preferably smaller than 0.1% by weight.

Mn: not larger than 1.0% by weight.

Mn acts to reinforce steel, and a necessary amount of Mn is added to steel in accordance with the intended strength of the steel. However, adding too much Mn to steel in an amount of larger than 1.0% by weight will have some negative influences on the deep drawability of the steel. Therefore, the amount of Mn to be in the steel of the invention is defined to be not larger than 1.0% by weight, but preferably from 0.05 to 0.15% by weight.

P: not larger than 0.15% by weight.

P acts to reinforce steel, and a necessary amount of P is added to steel in accordance with the intended strength of the steel. However, adding too much P to steel in an amount of larger than 0.15% by weight will have some negative influences on the deep drawability of the steel. Therefore, the amount of P to be in the steel of the invention is defined to be not larger than 0.15% by weight, but preferably smaller than 0.01% by weight.

S: not larger than 0.02% by weight.

More desirably, S is as smaller as possible for better deep drawability of sheet steel. S in steel in an amount of not larger than 0.02% by weight would not have any significant negative influences on the workability of the steel. Therefore, the S content of steel in the invention is defined to be not larger than 0.02%by weight, but preferably smaller than 0.008% by weight.

Al: from 0.01 to 0.10% by weight.

Al is for deoxidation of steel, and is added to steel for the purpose of increasing the yield of elements for producing carbonitrides in steel. However, Al added to steel in an amount of smaller than 0.01% by weight will be ineffective. On the other hand, even if Al is added in an amount of larger than 0.10% by weight, its effect will be no more augmented. Therefore, the amount of Al to be added is defined to fall between 0.01 and 0.10% by weight, but preferably between 0.02 and 0.06% by weight.

N: not larger than 0.008% by weight.

More desirably, N is as smaller as possible for better deep drawability of sheet steel. N in steel in an amount of not larger than 0.008% by weight would not have any significant negative influences on the workability of the steel. Therefore, the N content of steel in the invention is defined to be not larger than 0.008% by weight, but preferably smaller than 0.004% by weight.

Ti: from 0.035 to 0.20% by weight.

Ti is an element for forming carbonitrides in steel. This acts to reduce the solute C and the solute N in steel to be subjected to lubricative warm-rolling or to cold-rolling, and assists the orientation of grains predominantly in the site of {111}, while steel having been hot-rolled or cold-rolled is annealed, to thereby increase the r value (mean value) of the rolled sheet steel. However, Ti added to steel in an amount of smaller than 0.035% by weight will be ineffective. On the other hand, even if Ti is added in an amount of larger than 0.20% by weight, its effect will be no more augmented, but such too much Ti added will rather worsen the surface quality of the sheet steel. Therefore, the amount of Ti to be added is defined to fall between 0.035 and 0.20% by weight, but preferably between 0.04 and 0.08% by weight.

Nb: from 0.001 to 0.015% by weight.

Nb is also an element for forming carbonitrides in steel. Like Ti, this acts to reduce the solute C and the solute N in steel to be subjected to lubricative warm-rolling or to cold-rolling, and assists the orientation of grains predominantly in the site of {111}, while steel having been warm-rolled or cold-rolled is annealed. In addition, Nb acts to produce a fine texture of steel which is subjected to lubricative warm-rolling, and assists the orientation of grains predominantly in the site of {111} in the next step of annealing the rolled sheet steel. As having such capabilities, Nb is added to steel for the purpose of increasing the r value (mean value) of the rolled sheet steel. Moreover, the solute Nb in steel is further effective for accumulating the strain in the hot-rolled sheet steel, while promoting the growth of the texture of the hot-rolled sheet steel. However, Nb added to steel in an amount of smaller than 0.001% by weight will be ineffective. On the other hand, even if Nb is added in an amount of larger than 0.015% by weight, its effect will be no more augmented, but such too much Nb added to steel will rather cause an elevated recrystallization temperature of the steel. For these reasons, therefore, the amount of Ti to be added to steel in the invention is defined to fall between 0.001 and 0.015% by weight, but preferably between 0.01 and 0.015% by weight.

B: from 0.0001 to 0.01% by weight.

B is an element effective for improving steel to be non-brittle in secondary working, and is optionally added to steel. However, B added to steel in an amount of smaller than 0.0001% by weight will be ineffective. On the other hand, if B is added in an amount of larger than 0.01% by weight, the deep drawability of steel will be thereby worsened. Therefore, the amount of B to be added to steel in the invention is defined to fall between 0.0001 and 0.01% by weight, but preferably between 0.0002 and 0.0012% by weight. Sb of from 0.001 to 0.05% by weight; Bi of from 0.001 to 0.05% by weight; Se of from 0.001 to 0.05% by weight:

These elements are all effective for inhibiting oxidation and nitridation of steel slabs being re-heated or of steel sheets being annealed, and are optionally added to steel. However, if their amount added is smaller than 0.001% by weight, they will be ineffective. On the other hand, if they are added in an amount of larger than 0.05% by weight each, the deep drawability of steel will be thereby worsened. Therefore, the amount of these elements to be added to steel in the invention is defined to fall between 0.001 and 0.05% by weight each, but preferably between 0.005 and 0.015% by weight each.

1.2(C/12+N/14+S/32)<(Ti/48+Nb/93):

Where neither solute C nor solute N exists in a sheet bar to be subjected to lubricative warm rolling, the texture of the rolled and annealed sheet steel is oriented in the site of {111}. In the next cold-rolling and annealing steps, the sheet steel is much more oriented in the site of {111}, thereby having an increased mean r value. In the present invention, the elements C, N, S, Ti and Nb in the steel are so defined that they satisfy the requirement of 1.2(C/12+N/14+S/32)<(Ti/48+Nb/93). In other words, in the invention, Ti and Nb are added to steel, which are more than the equivalent amounts of C and N in the steel, so that neither solute C nor solute N exists in the steel prior to the lubricative warm rolling step.

(3) Production Conditions:

Thickness of Sheet Bar:

If sheet bars that are sufficiently thick could be prepared, thick cold-rolled sheets having an r value of not smaller than 2.9 could be produced from them, not only according to the method of the present invention but also according to the method disclosed in JP-A Hei-3-150316 or the like. In fact, however, the largest thickness of sheet bars is limited for the two reasons mentioned below, and thick cold-rolled sheets of steel having an r value of not smaller than 2.9 could not be produced in any prior art technique.

One reason is that the reduction ratio in rough hot-rolling must be at least 85%, and that the uppermost limit of the thickness of slabs is at most 200 mm or so in view of the capabilities of ordinary continuous casting lines and ordinary rough hot-rolling apparatus. Therefore, the uppermost limit of the thickness of sheet bars shall be at most 30 mm or so.

Another reason is that the uppermost limit of the coiling ability of the sheet bar coiler to be used in ordinary continuous rolling lines is generally at most 30 mm or so. This is because the secondary moment of the cross section of sheet steel is proportional to the third power of the thickness of the sheet steel, and because, in the present invention, since the coiling temperature for the sheet bar coiler is low or is around the $Ar_3$ transformation point of the steel so that the deformation resistance of the sheet bar being coiled is large, too thick sheet bars are difficult to coil and their mechanical properties will be worsened while they are forcedly coiled.

For the reasons noted above, the uppermost limit of the thickness of sheet bars capable of being actually worked in practical production lines is to be at most around 30 mm or so. As a result, in the conventional method for producing sheet steel having an r value of not smaller than 2.9, in which the reduction ratio for rough hot-rolling to be effected at a temperature falling between 600° C. and the $Ar_3$ transformation point of steel is higher than 90% and the reduction ratio for cold-rolling is not lower than 75%, it is difficult to produce thick cold-rolled sheet steel having a thickness of larger than 0.75 mm. In that method, if the reduction ratio for finishing hot-rolling is lowered in accordance with the thickness of the cold-rolled sheet, the r value of the sheet is also lowered. After all, in that method, when the reduction ratio for finishing hot-rolling is 86%, the cold-rolled sheet could have an r value of around 2.6 or so.

Given that situation, we, the present inventors have further studied and, as a result, have found that, when the reduction ratio for lubricative warm-rolling is further lowered, then the r value of the cold-rolled sheet is rather increased as opposed to the conventional knowledge. On the basis of this finding, we have completed the present invention. The reason for the result of the invention is because the reduction in the r value of the rolled sheet steel due to the decrease in the reduction ratio for lubricative warm rolling was well compensated for by the increase in the r value of the rolled sheet steel due to the decrease in the mean shear strain of the thick hot-rolled sheet. This is supported not only by the increase in the r value of the cold-rolled sheet but also by the increase in the r value of the pre-annealed sheet bar. In addition, in the method of the invention, since the reduction ratio for lubricative warm rolling is lowered to a certain degree, it is believed that the reduction ratio for cold rolling could be increased by the lowered degree of the reduction ratio for the previous lubricative warm rolling, thereby resulting in that, when the reduction ratio for the lubricative warm rolling to be effected at a temperature falling between 600° C. and the $Ar_3$ transformation point of steel is 85% or lower, then the r value of the cold-rolled sheet steel is rather increased.

The effects mentioned above are peculiar to the case where the uppermost limit of the thickness of sheet bars to be rolled is defined and the cold-rolled sheets from the bars are desired to be thick. This is because, in the other cases where thick sheet bars are rolled into thin cold-rolled sheets, the reduction ratio for lubricative warm rolling and also the reduction ratio in cold rolling could be large with no specific limitation, and cold-rolled sheets having a high r value could be obtained in any conventional rolling techniques. In the case like the invention, however, where the reduction ratios in both lubricative warm rolling and cold rolling could not be satisfactorily high, for example, where the reduction ratio for cold-rolled sheets is to be lower than 96.5% relative to the starting sheet bars, the reduction ratio for lubricative warm rolling is lowered to be lower than 85% and the thickness of the hot-rolled sheets is increased, whereby the r value of the cold-rolled sheets is extremely increased.

Mean Shear Strain:

In the method of the invention, the mean shear strain of the hot-rolled sheet is to be not larger than 0.06 after the lubricative warm-rolling step. The reasons for this have been described hereinabove, with reference to the data in FIG. 2 and FIG. 4.

Hot Rolling:

To increase the r value of cold-rolled sheets, the texture of steel must be oriented in the site of {111} after the sheet bars are hot-rolled and pre-annealed. For this, it is important that the sheet bars shall have fine and uniform texture prior to being subjected to lubricative warm rolling, and that a large amount of strain is accumulated as uniformly as possible in the hot-rolled sheets while the sheets are hot-rolled for finishing, to thereby orient the texture of the sheets predominantly in the site of {111} while the sheets are pre-annealed.

The rough hot-rolling of steel slabs must be finished at a temperature just above the $Ar_3$ transformation point of steel, in order that the texture of the hot-rolled sheets could be fine and uniform before the sheets are subjected to the next lubricative warm rolling, and that the $\gamma \rightarrow \alpha$ transformation could occur in the sheet just before the lubricative warm rolling step. On the other hand, however, if the temperature at which the rough hot-rolling is finished is higher than 950° C., the texture of the hot-rolled sheet being transformed will be restored to its original condition or the grains will grow in the texture during the step where the sheet is cooled to its Ar3 transformation point at which the $\gamma \rightarrow \alpha$ transformation occurs in the sheet, whereby the texture of the sheet will be rough and uneven before the sheet is hot-rolled for finishing in the next step. Therefore, the rough hot-rolling must not be effected at such high temperatures of higher than 950° C.

The reduction ratio for the rough hot-rolling must be at least 85% in order that the texture of the hot-rolled sheet bars could be fine.

In the finishing hot-rolling step, a large amount of strain is accumulated in the hot-rolled sheets. Therefore, the finishing hot-rolling must be effected in a warm condition at a temperature not higher than the $Ar_3$ transformation point of the steel. If the finishing hot-rolling is effected at a temperature higher than the $Ar_3$ transformation point of the steel, the $\gamma \rightarrow \alpha$ transformation will occur during the hot-rolling whereby the strain in the steel is released, or the texture of the hot-rolled sheet will be randomized. If so, the texture of the sheet could not be oriented predominantly in the site of {111} in the next annealing step. On the other hand, however, if the finishing hot-rolling temperature is lower than 600° C., the hot-rolling requires greatly increased rolling loads, which are impracticable.

In order to uniformly accumulate a large amount of strain in the warm-rolled sheets, the warm-rolling requires lubrication. If no lubrication is applied to the warm-rolling step, any additional but unfavorable shearing force will be imparted to the surface part of the sheet being rolled, due to the friction force between the roll and the surface of the sheet. If so, the texture of the sheet will be oriented not in the site of {111} after having been hot-rolled and annealed, whereby the r value of the cold-rolled sheet is lowered.

In the method of the invention, the reduction ratio for the lubricative warm-rolling is defined to be not lower than 65% so that the thickness of the hot-rolled sheet could be at least 5 mm. The reasons for this have been described hereinabove with reference to FIG. 2. More preferably, the thickness of the hot-rolled sheet is not smaller than 6 mm.

Pre-annealing (annealing of hot-rolled sheet):

In order to increase the r value of the cold-rolled sheet steel of the invention, it is important that the texture of the sheet having been hot-rolled and annealed is oriented predominantly in the site of {111}. For this, it is necessary that the hot-rolled sheet having a lowered mean shear strain is heated at a temperature falling between 700 and 920° C. for recrystallization prior to being cold-rolled. After thus pre-annealed, the texture of the sheet can be oriented in the site of {111}. In this step, if the heating temperature is lower than 700° C., the intended recrystallization and grain growth could not be attained in ordinary industrial lines, and therefore the intended {111} orientation could not be attained. On the other hand, if the heating temperature in the step is higher than 920° C., the $\alpha \rightarrow \gamma$ transformation will occur to randomize the texture of the sheet. The annealing may be effected either in box annealing or continuous annealing.

In order to increase the r value of the cold-rolled sheet, it is advantageous that the ferrite grains in the sheet are made fine prior to the cold-rolling step. More preferably, for this, the annealing is effected under the condition under which the ferrite grains in the annealed sheet could be not larger than 50 $\mu$m in size.

Cold Rolling:

The reduction ratio for the cold rolling in the method of the invention must be indispensably at least 65% or more, in order that the texture of the cold-rolled sheet could be well grown and that the r value of the cold-rolled sheet could be well high. However, for cold-rolled sheets having a thickness of 1.2 mm or more, the reduction ratio for the cold rolling of 85% or larger will be impracticable, since the loads to the rolling lines shall be too great.

Recrystallization Annealing (finishing annealing):

After the cold-rolling step, the cold-rolled sheet steel must be annealed for recrystallization. The annealing may be effected either in box annealing or continuous annealing, in which, however, the heating temperature shall fall between the recrystallization temperature of the steel (about 700° C.) and 920° C. More preferably, the cold-rolled sheet is annealed in high-temperature continuous annealing at a temperature falling between 830° C. and 900° C. for a period of from 20 to 60 seconds. As a result of the recrystallization annealing, the texture of the annealed sheet is much more oriented in the site of {111}. Optionally, the annealed sheet steel may be temper-rolled for correcting its shape and for controlling its surface roughness.

The cold-rolled sheet as obtained according to the method mentioned above can be used as a substrate to be worked and surface-treated. The surface treatment includes galvanization (zinc-plating), tin-plating, enameling, etc.

EXAMPLES

The invention is described concretely with reference to the following Examples.

Example 1

A steel sample having the composition No. 1 shown in Table 1 was subjected to rough hot-rolling, finishing hot-rolling, then pickling, pre-annealing, cold-rolling and finishing annealing under the conditions indicated in Tables 2 and 3. Precisely, for the finishing hot-rolling, used was a 7-stage tandem rolling machine equipped with rolls having a radius of 370 mm. The friction coefficient in the finishing hot-rolling step was from 0.2 to 0.25 in every stand.

The mean shear strain in the hot-rolled sheet was obtained according to the method mentioned below.

Figure 6:
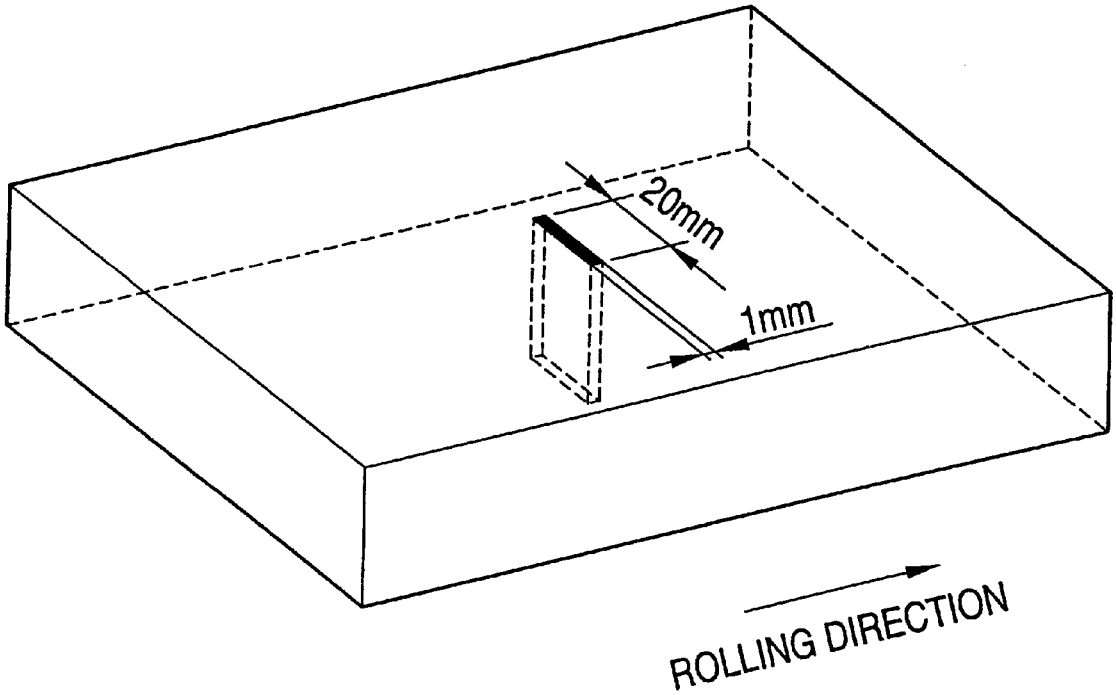
FIG. 6 is an explanatory view showing a slit (cutting) as formed in sheet steel for measuring the shear strain of the sheet steel in the invention.

As in FIG. 6, a slit (cutting) of 1 mm (width)×20mm (depth) was formed in a slab to be rolled, at its center relative to the widthwise direction of the slab, and in the direction vertical to the rolling direction of the slab, and the slab was hot-rolled (finishing hot-rolling), whereupon the shear strain of the finishing-hot-rolled sheet was obtained from the deformation of the slit. On the other hand, the slab with the slit was hot-rolled (rough hot-rolling) to obtain the shear strain of the rough hot-rolled sheet in the same manner as above. The value of the shear strain of the rough-hot-rolled sheet was subtracted from that of the finishing-hot-rolled sheet to obtain the shear strain of the finishing-hot-rolled sheet from the starting sheet bar. The measurement was effected in different points that vary relative to the thickness of each sheet. The data thus obtained were averaged relative to the thickness of the sheet to obtain the mean shear strain of the sheet. The mean shear strain of each finishing-hot-rolled sheet thus obtained in the manner noted above is shown in the following Tables.

Of each cold-rolled sheet sample, cut out were JIS No. 5, tensile test pieces. Each test piece was, after having been pre-strained for 15% elongation, subjected to a three-point elongation test, in which was obtained the r value (mean value) of each sample according to the equation (1) mentioned above. The data thus obtained are shown in Table 2 and Table 3.

From Tables 1 to 3, it is known that thick cold-rolled sheet steel samples having a high r value of not lower than 2.9 and having a thickness of not smaller than 1.2, which the comparative samples could not have, were obtained according to the method of the present invention which comprises subjecting slabs to finishing hot-rolling under a lubricative condition to a reduction ratio of not lower than 65%, into sheets having a thickness of not smaller than 5 mm and having a mean shear strain of not larger than 0.06, followed by cold-rolling the sheets to a reduction ratio of not lower than 65%.

Example 2

Slabs of different compositions as in Table 1 were subjected to rough hot-rolling, finishing hot-rolling, then pickling, pre-annealing, cold-rolling and finishing annealing under the conditions indicated in Table 4. The mean shear strain of each hot-rolled sample and the r value of each cold-rolled sample were measured in the same manner as in Example 1.

The data obtained are shown in Table 4.

From Table 4, it is known that the thick cold-rolled sheet steel samples obtained according to the method of the present invention had a high r value of not lower than 2.9 and a thickness of not smaller than 1.2, which the comparative samples could not have.

INDUSTRIAL APPLICABILITY

As described hereinabove, the present invention provides thick cold-rolled sheet steel with excellent deep drawability, which has an r value of not smaller than 2.9 and a thickness of not smaller than 1.2 and which is produced on an industrial scale.

Therefore, according to the invention, it is easy to produce compressor covers, oil pans for vehicles and the like, which have heretofore been produced by welding a plurality of molded parts or by drawing sheet steel in repeated drawing steps in the prior art, by simply pressing the thick cold-rolled sheet steel of the invention.

In addition, according to the method of the invention, it is possible to practically produce the thick cold-rolled sheet steel which has such a high r value and is therefore extremely valuable in practical use. As opposed to this, conventional rolling methods are problematic in that, when thick slabs or sheet bars are rolled, then the reduction ratio shall increase, the thick slabs or sheet bars often fail to be rolled in good order, the rolling load shall increase, and, in continuous rolling, the sheet bar coiler used shall be worked over its coiling ability. In addition, conventional rolling methods are further problematic in that, when thick slabs or sheet bars are rolled under a lubricative condition, they often fail to be rolled in good order and often slip on the rolls. For these reasons, it is in fact impossible to roll such thick slabs or sheet bars in conventional rolling methods.

The present invention has made it possible to produce thick cold-rolled sheet steel having a high r value, which, in fact, could not be produced in conventional rolling methods.

TABLE 1

| | Chemical Component s(wt. %) | | | | | | | | | | | | |
|---|---|---|---|---|---|---|---|---|---|---|---|---|---|
| No | C | Si | Mn | P | S | Al | N | Ti | Nb | B | Sb | Equation* | $Ar_3$, + C. |
| 1 | 0.0012 | 0.010 | 0.121 | 0.003 | 0.005 | 0.049 | 0.0020 | 0.070 | 0.015 | 0.0004 | 0.0090 | satisfied | 910 |
| 2 | 0.0010 | 0.010 | 0.113 | 0.010 | 0.005 | 0.051 | 0.0021 | 0.068 | 0.014 | 0.0004 | 0.0090 | satisfied | 910 |
| 3 | 0.0010 | 0.010 | 0.125 | 0.010 | 0.005 | 0.020 | 0.0019 | 0.068 | 0.015 | 0.0004 | trace | satisfied | 915 |
| 4 | 0.0018 | 0.010 | 0.120 | 0.010 | 0.002 | 0.051 | 0.0019 | 0.069 | 0.014 | 0.0004 | 0.0090 | satisfied | 910 |
| 5 | 0.0010 | 0.011 | 0.113 | 0.005 | 0.005 | 0.053 | 0.0020 | 0.073 | 0.014 | trace | 0.0090 | satisfied | 915 |
| 6 | 0.0010 | 0.011 | 0.125 | 0.005 | 0.002 | 0.020 | 0.0019 | 0.068 | 0.015 | trace | trace | satisfied | 920 |
| 7 | 0.0020 | 0.010 | 0.124 | 0.011 | 0.005 | 0.051 | 0.0021 | 0.014 | 0.016 | 0.0004 | 0.0090 | satisfied | 910 |
| 8 | 0.0020 | 0.011 | 0.119 | 0.010 | 0.005 | 0.048 | 0.0019 | 0.070 | 0.001 | 0.0004 | 0.0090 | satisfied | 910 |
| 9 | 0.0019 | 0.010 | 0.116 | 0.009 | 0.005 | 0.048 | 0.0020 | 0.015 | 0.001 | 0.0004 | 0.0090 | not satisfied | 880 |

*Equation: $1.2(C/12 + N/14 + S/32) < (Ti/48 + Nb/93)$

TABLE 2

| | | | Rough Hot Rolling | | | Finishing Hot Rolling | | | | | | |
|---|---|---|---|---|---|---|---|---|---|---|---|---|
| Test No. | Steel No. | Slab Reheating Temp. (° C.) | 950° C. to $Ar_3$, reduction ratio (%) | RDT (° C.) | Thickness of Sheet Bar (mm) | FET (° C.) | Lubrication | $Ar_3$ to 600° C., reduction ratio (%) | Mean Shear Strain | FDT (° C.) | Coiling Temp. (° C.) | Thickness of Hot-Rolled Sheet |
| 1 | 1 | 1050 | 85 | 920 | 33 | 820 | Yes | 89.4 | 0.088 | 680 | 550 | 3.5 |
| 2 | 1 | 1050 | 85 | 920 | 33 | 820 | Yes | 87.9 | 0.076 | 680 | 550 | 4.0 |
| 3 | 1 | 1050 | 85 | 920 | 33 | 820 | Yes | 86.4 | 0.067 | 680 | 550 | 4.5 |
| 4 | 1 | 1050 | 85 | 920 | 33 | 820 | Yes | 84.8 | 0.060 | 680 | 550 | 5.0 |
| 5 | 1 | 1050 | 85 | 920 | 33 | 820 | Yes | 83.3 | 0.054 | 680 | 550 | 5.5 |
| 6 | 1 | 1050 | 55 | 920 | 33 | 820 | Yes | 81.8 | 0.049 | 680 | 550 | 6.0 |
| 7 | 1 | 1050 | 85 | 920 | 33 | 820 | Yes | 78.8 | 0.041 | 680 | 550 | 7.0 |
| 8 | 1 | 1050 | 85 | 920 | 33 | 820 | Yes | 77.3 | 0.038 | 680 | 550 | 7.5 |
| 9 | 1 | 1050 | 85 | 920 | 33 | 820 | Yes | 89.4 | 0.088 | 680 | 550 | 3.5 |
| 10 | 1 | 1050 | 85 | 920 | 33 | 820 | Yes | 87.9 | 0.076 | 680 | 550 | 4.0 |
| 11 | 1 | 1050 | 85 | 920 | 33 | 820 | Yes | 86.4 | 0.067 | 680 | 550 | 4.5 |
| 12 | 1 | 1050 | 85 | 920 | 33 | 820 | Yes | 84.8 | 0.060 | 680 | 550 | 5.0 |
| 13 | 1 | 1050 | 85 | 920 | 33 | 820 | Yes | 83.3 | 0.054 | 680 | 550 | 5.5 |
| 14 | 1 | 1050 | 85 | 920 | 33 | 820 | Yes | 81.8 | 0.049 | 680 | 550 | 6.0 |
| 15 | 1 | 1050 | 85 | 920 | 33 | 820 | Yes | 78.8 | 0.041 | 680 | 550 | 7.0 |
| 16 | 1 | 1050 | 85 | 920 | 33 | 820 | Yes | 77.3 | 0.038 | 680 | 550 | 7.5 |
| 17 | 1 | 1050 | 85 | 920 | 33 | 820 | Yes | 96.1 | 0.066 | 680 | 550 | 4.6 |
| 18 | 1 | 1050 | 85 | 920 | 33 | 820 | Yes | 84.8 | 0.060 | 680 | 550 | 5.0 |
| 19 | 1 | 1050 | 85 | 920 | 33 | 820 | Yes | 83.3 | 0.054 | 680 | 550 | 5.5 |
| 20 | 1 | 1050 | 85 | 920 | 33 | 820 | Yes | 81.8 | 0.049 | 680 | 550 | 6.0 |

TABLE 2-continued

| | | | | | | | | | | | | |
|---|---|---|---|---|---|---|---|---|---|---|---|---|
| 21 | 1 | 1050 | 85 | 920 | 33 | 820 | Yes | 78.8 | 0.041 | 680 | 550 | 7.0 |
| 22 | 1 | 1050 | 85 | 920 | 33 | 820 | Yes | 77.3 | 0.038 | 680 | 550 | 7.5 |
| 23 | 1 | 1050 | 85 | 920 | 25 | 820 | Yes | 86.0 | 0.086 | 680 | 550 | 3.5 |
| 24 | 1 | 1050 | 85 | 920 | 25 | 820 | Yes | 84.0 | 0.075 | 680 | 550 | 4.0 |
| 25 | 1 | 1050 | 85 | 920 | 25 | 820 | Yes | 82.0 | 0.066 | 680 | 550 | 4.5 |
| 26 | 1 | 1050 | 85 | 920 | 25 | 820 | Yes | 80.0 | 0.058 | 680 | 550 | 5.0 |
| 27 | 1 | 1050 | 85 | 920 | 25 | 820 | Yes | 78.0 | 0.052 | 680 | 550 | 5.5 |
| 28 | 1 | 1050 | 85 | 920 | 25 | 820 | Yes | 76.0 | 0.047 | 680 | 550 | 6.0 |
| 29 | 1 | 1050 | 85 | 920 | 25 | 820 | Yes | 72.0 | 0.039 | 680 | 550 | 7.0 |
| 30 | 1 | 1050 | 85 | .920 | 25 | 820 | Yes | 70.0 | 0.036 | 680 | 550 | 7.5 |

| Test | Annealing of Hot-Rolled Sheet | | Cold Rolling | | Finishing Annealing | | | |
|---|---|---|---|---|---|---|---|---|
| No. | Temp. (° C.) | time (sec) | Reduction Ratio (%) | Thickness of Cold-Rolled Sheet (mm) | Temp. (° C.) | time (sec) | r Value | Remarks |
| 1 | 750 | 18000 | 65.7 | 1.20 | 895 | 40 | 2.50 | comparison |
| 2 | 750 | 18000 | 70.0 | 1.20 | 895 | 40 | 2.60 | comparison |
| 3 | 750 | 18000 | 73.3 | 1.20 | 895 | 40 | 2.70 | comparison |
| 4 | 750 | 18000 | 76.0 | 1.20 | 895 | 40 | 3.03 | the invention |
| 5 | 750 | 18000 | 78.2 | 1.20 | 895 | 40 | 3.11 | the invention |
| 6 | 750 | 18000 | 80.0 | 1.20 | 895 | 40 | 3.18 | the invention |
| 7 | 750 | 18000 | 82.9 | 1.20 | 895 | 40 | 3.12 | the invention |
| 8 | 750 | 18000 | 84.0 | 1.20 | 895 | 40 | 3.14 | the invention |
| 9 | 750 | 18000 | 50.0 | 1.40 | 895 | 40 | 2.40 | comparison |
| 10 | 750 | 18000 | 65.0 | 1.40 | 895 | 40 | 2.50 | comparison |
| 11 | 750 | 18000 | 68.9 | 1.40 | 895 | 40 | 2.70 | comparison |
| 12 | 750 | 18000 | 72.0 | 1.40 | 895 | 40 | 2.96 | the invention |
| 13 | 750 | 18000 | 74.5 | 1.40 | 895 | 40 | 3.03 | the invention |
| 14 | 750 | 18000 | 76.7 | 1.40 | 895 | 40 | 3.14 | the invention |
| 15 | 750 | 18000 | 80.0 | 1.40 | 895 | 40 | 2.99 | the invention |
| 16 | 750 | 18000 | 81.3 | 1.40 | 895 | 40 | 3.00 | the invention |
| 17 | 750 | 18000 | 65.2 | 1.60 | 895 | 40 | 2.60 | comparison |
| 18 | 750 | 18000 | 68.0 | 1.60 | 895 | 40 | 2.92 | the invention |
| 19 | 750 | 18000 | 70.9 | 1.60 | 895 | 40 | 2.97 | the invention |
| 20 | 750 | 18000 | 73.3 | 1.60 | 895 | 40 | 3.01 | the invention |
| 21 | 750 | 18000 | 77.1 | 1.60 | 895 | 40 | 2.90 | the invention |
| 22 | 750 | 18000 | 78.7 | 1.60 | 895 | 40 | 2.95 | the invention |
| 23 | 750 | 18000 | 65.7 | 1.20 | 895 | 40 | 2.40 | comparison |
| 24 | 750 | 18000 | 70.0 | 1.20 | 895 | 40 | 2.50 | comparison |
| 25 | 750 | 18000 | 73.3 | 1.20 | 895 | 40 | 2.70 | comparison |
| 26 | 750 | 18000 | 76.0 | 1.20 | 895 | 40 | 2.97 | the invention |
| 27 | 750 | 18000 | 78.2 | 1.20 | 895 | 40 | 3.07 | the invention |
| 28 | 750 | 18000 | 80.0 | 1.20 | 895 | 40 | 3.11 | the invention |
| 29 | 750 | 18000 | 82.9 | 1.20 | 895 | 40 | 3.05 | the invention |
| 30 | 750 | 18000 | 84.0 | 1.20 | 895 | 40 | 2.95 | the invention |

Notes)
RDT: Rough Delivery Temperature, FET: Finishing Entrance Temperature, FDT: Finishing Delivery Temperature

TABLE 3

| | | | Rough Hot Rolling | | | Finishing Hot Rolling | | | | | | |
|---|---|---|---|---|---|---|---|---|---|---|---|---|
| Test No. | Steel No. | Slab Reheating Temp. (° C.) | 950° C. to $Ar_3$, reduction ratio (%) | RDT (° C.) | Thickness of Sheet Bar (mm) | FET (° C.) | Lubrication | $Ar_3$ to 600° C., reduction ratio (%) | Mean Shear Strain | FDT (° C.) | Coiling Temp. (° C.) | Thickness of Hot-Rolled Sheet |
| 31 | 1 | 1050 | 85 | 920 | 25 | 820 | Yes | 86.0 | 0.086 | 680 | 550 | 3.5 |
| 32 | 1 | 1050 | 85 | 920 | 25 | 820 | Yes | 84.0 | 0.075 | 680 | 550 | 4.0 |
| 33 | 1 | 1050 | 85 | 920 | 25 | 820 | Yes | 82.0 | 0.066 | 680 | 550 | 4.5 |
| 34 | 1 | 1050 | 85 | 920 | 25 | 820 | Yes | 80.0 | 0.058 | 680 | 550 | 5.0 |
| 35 | 1 | 1050 | 85 | 920 | 25 | 820 | Yes | 78.0 | 0.052 | 680 | 550 | 5.5 |
| 36 | 1 | 1050 | 85 | 920 | 25 | 820 | Yes | 76.0 | 0.047 | 680 | 550 | 6.0 |
| 37 | 1 | 1050 | 85 | 920 | 25 | 820 | Yes | 72.0 | 0.039 | 680 | 550 | 7.0 |
| 38 | 1 | 1050 | 85 | 920 | 25 | 820 | Yes | 70.0 | 0.038 | 680 | 550 | 7.5 |
| 39 | 1 | 1050 | 85 | 920 | 25 | 820 | Yes | 81.6 | 0.064 | 680 | 550 | 4.6 |
| 40 | 1 | 1050 | 85 | 920 | 25 | 820 | Yes | 80.0 | 0.058 | 680 | 650 | 5.0 |
| 41 | 1 | 1050 | 85 | 920 | 25 | 820 | Yes | 78.0 | 0.052 | 680 | 550 | 5.5 |
| 42 | 1 | 1050 | 85 | 920 | 25 | 820 | Yes | 76.0 | 0.047 | 680 | 550 | 6.0 |
| 43 | 1 | 1050 | 85 | 920 | 25 | 820 | Yes | 72.0 | 0.039 | 680 | 550 | 7.0 |
| 44 | 1 | 1050 | 85 | 920 | 25 | 820 | Yes | 70.0 | 0.036 | 680 | 550 | 7.5 |
| 45 | 1 | 1050 | 85 | 920 | 20 | 820 | Yes | 82.5 | 0.085 | 680 | 550 | 3.5 |
| 46 | 1 | 1050 | 85 | 920 | 20 | 820 | Yes | 80.0 | 0.073 | 680 | 550 | 4.0 |
| 47 | 1 | 1050 | 85 | 920 | 20 | 820 | Yes | 77.5 | 0.064 | 680 | 550 | 4.5 |

TABLE 3-continued

| | | | | | | | | | | | | |
|---|---|---|---|---|---|---|---|---|---|---|---|---|
| 48 | 1 | 1050 | 85 | 920 | 20 | 820 | Yes | 75.0 | 0.056 | 680 | 550 | 5.0 |
| 49 | 1 | 1050 | 85 | 920 | 20 | 820 | Yes | 72.5 | 0.050 | 680 | 550 | 5.5 |
| 50 | 1 | 1050 | 85 | 920 | 20 | 820 | Yes | 70.0 | 0.045 | 680 | 550 | 6.0 |
| 51 | 1 | 1050 | 85 | 920 | 20 | 820 | Yes | 65.0 | 0.038 | 680 | 550 | 7.0 |
| 52 | 1 | 1050 | 85 | 920 | 20 | 820 | Yes | 62.5 | 0.034 | 680 | 550 | 7.5 |
| 53 | 1 | 1050 | 85 | 920 | 20 | 820 | Yes | 82.5 | 0.085 | 680 | 550 | 3.5 |
| 54 | 1 | 1050 | 85 | 920 | 20 | 820 | Yes | 80.0 | 0.073 | 680 | 550 | 4.0 |
| 55 | 1 | 1050 | 85 | 920 | 20 | 820 | Yes | 77.5 | 0.064 | 680 | 550 | 4.5 |
| 56 | 1 | 1050 | 85 | 920 | 20 | 820 | Yes | 75.0 | 0.056 | 680 | 550 | 5.0 |
| 57 | 1 | 1050 | 85 | 920 | 20 | 820 | Yes | 72.5 | 0.050 | 680 | 550 | 5.5 |
| 58 | 1 | 1050 | 85 | 920 | 20 | 820 | Yes | 70.0 | 0.045 | 680 | 550 | 6.0 |
| 59 | 1 | 1050 | 85 | 920 | 20 | 820 | Yes | 65.0 | 0.038 | 680 | 550 | 7.0 |

| Test | Annealing of Hot-Rolled Sheet | | Cold Rolling | | Finishing Annealing | | | |
|---|---|---|---|---|---|---|---|---|
| No. | Temp. (° C.) | time (sec) | Reduction Ratio (%) | Thickness of Cold-Rolled Sheet (mm) | Temp. (° C.) | time (sec) | r Value | Remarks |
| 31 | 750 | 18000 | 60.0 | 1.40 | 895 | 49 | 2.30 | comparison |
| 32 | 750 | 18000 | 65.0 | 1.40 | 895 | 40 | 2.40 | comparison |
| 33 | 750 | 18000 | 68.9 | 1.40 | 895 | 40 | 2.60 | comparison |
| 34 | 750 | 18000 | 72.0 | 1.40 | 895 | 40 | 2.92 | the invention |
| 35 | 750 | 18000 | 74.5 | 1.40 | 895 | 40 | 2.97 | the invention |
| 36 | 750 | 16000 | 76.7 | 1.40 | 895 | 40 | 3.09 | the invention |
| 37 | 750 | 18000 | 80.0 | 1.40 | 895 | 40 | 2.90 | the invention |
| 38 | 750 | 18000 | 81.3 | 1.40 | 895 | 40 | 2.90 | the invention |
| 39 | 750 | 18000 | 65.2 | 1.60 | 895 | 40 | 2.50 | comparison |
| 40 | 750 | 18000 | 68.0 | 1.60 | 895 | 40 | 2.94 | the invention |
| 41 | 750 | 18000 | 70.9 | 1.60 | 895 | 40 | 2.93 | the invention |
| 42 | 750 | 18000 | 73.3 | 1.60 | 895 | 40 | 2.97 | the invention |
| 43 | 750 | 18000 | 77.1 | 1.60 | 895 | 40 | 2.93 | the invention |
| 44 | 750 | 18000 | 78.7 | 1.60 | 895 | 40 | 2.90 | the invention |
| 45 | 750 | 18000 | 65.7 | 1.20 | 895 | 40 | 2.30 | comparison |
| 46 | 750 | 18000 | 70.0 | 1.20 | 895 | 40 | 2.40 | comparison |
| 47 | 750 | 18000 | 73.3 | 1.20 | 895 | 40 | 2.60 | comparison |
| 48 | 750 | 16000 | 76.0 | 1.20 | 895 | 40 | 2.90 | the invention |
| 49 | 750 | 18000 | 78.2 | 1.20 | 895 | 40 | 3.03 | the invention |
| 50 | 750 | 18000 | 80.0 | 1.20 | 895 | 40 | 3.06 | the invention |
| 51 | 750 | 18000 | 82.9 | 1.20 | 895 | 40 | 3.03 | the invention |
| 52 | 750 | 18000 | 84.0 | 1.20 | 895 | 40 | 2.60 | comparison |
| 53 | 750 | 18000 | 60.0 | 1.40 | 895 | 40 | 2.20 | comparison |
| 54 | 750 | 18000 | 65.0 | 1.40 | 895 | 40 | 2.30 | comparison |
| 55 | 750 | 18000 | 68.9 | 1.40 | 895 | 40 | 2.50 | comparison |
| 56 | 750 | 18000 | 72.0 | 1.40 | 895 | 40 | 2.93 | the invention |
| 57 | 750 | 18000 | 74.5 | 1.40 | 895 | 40 | 2.91 | the invention |
| 58 | 750 | 18000 | 76.7 | 1.40 | 895 | 40 | 3.03 | the invention |
| 59 | 750 | 18000 | 80.0 | 1.40 | 895 | 40 | 2.92 | the invention |

Notes)
RDT: Rough Delivery Temperature, FET: Finishing Entrance Temperature, FDT: Finishing Delivery Temperature

TABLE 4

| | | | Rough Hot Rolling | | | Finishing Hot Rolling | | | | | | |
|---|---|---|---|---|---|---|---|---|---|---|---|---|
| Test No. | Steel No. | Slab Reheating Temp. (° C.) | 950° C. to $Ar_3$, reduction ratio (%) | RDT (° C.) | Thickness of Sheet Bar (mm) | FET (° C.) | Lubrication | $Ar_3$ to 600° C., reduction ratio (%) | Mean Shear Strain | FDT (° C.) | Coiling Temp. (° C.) | Thickness of Hot-Rolled Sheet |
| 60 | 1 | 1050 | 85 | 920 | 20 | 820 | Yes | 62.5 | 0.034 | 680 | 550 | 7.5 |
| 61 | 1 | 1050 | 85 | 920 | 20 | 820 | Yes | 77.0 | 0.062 | 680 | 550 | 4.6 |
| 62 | 1 | 1050 | 85 | 920 | 20 | 820 | Yes | 75.0 | 0.056 | 680 | 550 | 5.0 |
| 63 | 1 | 1050 | 85 | 920 | 20 | 820 | Yes | 72.5 | 0.050 | 680 | 550 | 5.5 |
| 64 | 1 | 1050 | 85 | 920 | 20 | 820 | Yes | 70.0 | 0.045 | 680 | 550 | 6.0 |
| 65 | 1 | 1050 | 85 | 920 | 20 | 820 | Yes | 65.0 | 0.038 | 680 | 550 | 7.0 |
| 66 | 1 | 1050 | 85 | 920 | 20 | 820 | Yes | 62.5 | 0.034 | 680 | 550 | 7.5 |
| 67 | 1 | 1020 | 85 | 920 | 30 | 810 | Yes | 80.0 | 0.048 | 680 | 580 | 6.0 |
| 68 | 1 | 1020 | 85 | 920 | 30 | 810 | No | 80.0 | 0.190 | 680 | 580 | 6.0 |
| 69 | 2 | 1050 | 85 | 920 | 30 | 810 | Yes | 81.7 | 0.050 | 680 | 580 | 5.5 |
| 70 | 3 | 1000 | 85 | 920 | 30 | 810 | Yes | 81.7 | 0.050 | 680 | 580 | 5.5 |
| 71 | 4 | 980 | 85 | 920 | 30 | 820 | Yes | 80.0 | 0.047 | 660 | 580 | 6.0 |
| 72 | 5 | 1000 | 85 | 920 | 30 | 780 | Yes | 76.7 | 0.042 | 630 | 530 | 7.0 |
| 73 | 6 | 1050 | 85 | 920 | 25 | 780 | Yes | 80.0 | 0.058 | 600 | 500 | 5.0 |
| 74 | 6 | 1050 | 80 | 920 | 30 | 780 | Yes | 83.3 | 0.059 | 600 | 500 | 5.0 |
| 75 | 7 | 1050 | 85 | 920 | 30 | 820 | Yes | 83.3 | 0.059 | 680 | 580 | 5.0 |

TABLE 4-continued

| | | | | | | | | | | | | |
|---|---|---|---|---|---|---|---|---|---|---|---|---|
| 76 | 8 | 1050 | 85 | 920 | 30 | 820 | Yes | 80.0 | 0.048 | 680 | 580 | 6.0 |
| 77 | 9 | 1050 | 85 | 920 | 30 | 820 | Yes | 80.0 | 0.047 | 680 | 580 | 6.0 |

| Test | Annealing of Hot-Rolled Sheet | | Cold Rolling | | Finishing Annealing | | | |
|---|---|---|---|---|---|---|---|---|
| No. | Temp. (° C.) | time (sec) | Reduction Ratio (%) | Thickness of Cold-Rolled Sheet (mm) | Temp. (° C.) | time (sec) | r Value | Remarks |
| 60 | 750 | 18000 | 81.3 | 1.40 | 895 | 40 | 2.50 | comparison |
| 61 | 750 | 18000 | 65.2 | 1.60 | 895 | 40 | 2.40 | comparison |
| 62 | 750 | 18000 | 68.0 | 1.60 | 895 | 40 | 2.93 | the invention |
| 63 | 750 | 18000 | 70.9 | 1.60 | 895 | 40 | 2.91 | the invention |
| 64 | 750 | 18000 | 73.3 | 1.60 | 895 | 40 | 2.91 | the invention |
| 65 | 750 | 18000 | 77.1 | 1.60 | 895 | 40 | 2.93 | the invention |
| 66 | 750 | 18000 | 78.7 | 1.60 | 895 | 40 | 2.40 | comparison |
| 67 | 890 | 40 | 80.0 | 1.20 | 900 | 40 | 3.10 | the invention |
| 68 | 890 | 40 | 80.0 | 1.20 | 900 | 40 | 2.40 | comparison |
| 69 | 750 | 18000 | 74.5 | 1.40 | 800 | 18000 | 2.95 | the invention |
| 70 | 700 | 36000 | 67.3 | 1.80 | 700 | 36000 | 3.03 | the invention |
| 71 | 750 | 18000 | 73.3 | 1.60 | 910 | 40 | 3.14 | the invention |
| 72 | 750 | 18000 | 80.0 | 1.40 | 900 | 40 | 3.00 | the invention |
| 73 | 750 | 18000 | 72.0 | 1.40 | 840 | 40 | 3.07 | the invention |
| 74 | 750 | 18000 | 72.0 | 1.40 | 840 | 40 | 2.80 | comparison |
| 75 | 750 | 18000 | 76.0 | 1.20 | 900 | 40 | 2.40 | comparison |
| 76 | 750 | 18000 | 80.0 | 1.20 | 900 | 40 | 2.60 | comparison |
| 77 | 750 | 18000 | 76.7 | 1.40 | 900 | 40 | 2.40 | comparison |

Notes)
RDT: Rough Delivery Temperature, FET: Finishing Entrance Temperature, FDT: Finishing Delivery Temperature

What is claimed is:

1. A method for producing thick cold-rolled sheet steel from a steel slab having a composition that comprises at most 0.008% by weight of C, at most 0.5% by weight of Si, at most 1.0% by weight of Mn, at most 0.15% by weight of P, at most 0.02% by weight of S, from 0.01 to 0.10% by weight of Al, at most 0.008% by weight of N, from 0.035 to 0.20% by weight of Ti, and from 0.001 to 0.015% by weight of Nb, with a balance of Fe and inevitable impurities, wherein C, S, N, Ti and Nb satisfy the following condition (1):

$$1.2(C/12+N/14+S/32)<(Ti/48+Nb/93) \quad (1),$$

the method comprising subjecting said steel slab to rough hot-rolling to a reduction ratio of not lower than 85%, at a temperature falling between the $Ar_3$ transformation point of the steel and 950° C. to form sheet bar, then subjecting the sheet bar to lubricative warm-rolling for finishing hot-rolling to a reduction ratio of not lower than 65%, at a temperature falling between 600° C. and the $Ar_3$ transformation point of the steel, while lubricating the sheet bar, to thereby make the sheet bar into a sheet steel having a mean shear strain of not larger than 0.06, then pickling the sheet steel, then pre-annealing the sheet steel at a temperature falling between 700 and 920° C., then cold-rolling the sheet steel to a reduction ratio of not lower than 65%, and thereafter further annealing the sheet steel for recrystallization at a temperature falling between 700 and 920° C.

2. The method for producing thick cold-rolled sheet steel as claimed in claim 1, wherein the sheet steel has excellent deep drawability, a thickness of not less than 1.2 mm and an r value defined by the following equation (2) of not smaller than 2.9:

$$r=(r_0+2r_{45}+r_{90})/4 \quad (2)$$

wherein $r_0$, $r_{45}$ and $r_{90}$ indicate the Lankford value of the sheet steel in the rolling direction, the Lankford value in the direction at an angle of 45° relative to the rolling direction, and the Lankford value in the direction at an angle of 90° relative to the rolling direction, respectively.

3. The method for producing thick cold-rolled sheet steel as claimed in claim 1, wherein the thickness of the hot-rolled sheet after the lubricative warm-rolling step is not smaller than 5 mm.

4. The method for producing thick cold-rolled sheet steel as claimed in claim 3, wherein the steel composition further comprises B in an amount of from 0.0001 to 0.01% by weight.

5. The method for producing thick cold-rolled sheet steel as claimed in claim 3, wherein the steel composition further comprises at least one element selected from the group consisting of from 0.001 to 0.05% by weight of Sb, from 0.001 to 0.05% by weight of Bi and from 0.001 to 0.05% by weight of Se.

6. The method for producing thick cold-rolled sheet steel as claimed in claim 1, wherein the steel composition further comprises B in an amount of from 0.0001 to 0.01% by weight.

7. The method for producing thick cold-rolled sheet steel as claimed in claim 6, wherein the steel composition further comprises at least one element selected from the group consisting of from 0.001 to 0.05% by weight of Sb, from 0.001 to 0.05% by weight of Bi and from 0.001 to 0.05% by weight of Se.

8. The method for producing thick cold-rolled sheet steel as claimed in claim 1, wherein the steel composition further comprises at least one element selected from the group consisting of from 0.001 to 0.05% by weight of Sb, from 0.001 to 0.05% by weight of Bi and from 0.001 to 0.05% by weight of Se.

9. A method for producing thick cold-rolled sheet steel from a steel slab having a composition that comprises at most 0.008% by weight of C, at most 0.5% by weight of Si, at most 1.0% by weight of Mn, at most 0.15% by weight of P, at most 0.02% by weight of S, from 0.01 to 0.10% by weight of Al, at most 0.008% by weight of N, from 0.035 to 0.20% by weight of Ti, and from 0.001 to 0.015% by weight of Nb, with a balance of Fe and inevitable impurities, wherein C, S, N, Ti and Nb satisfy the following condition (1):

$$1.2(C/12+N/14+S/32)<(Ti/48+Nb/93) \quad (1),$$

the method comprising subjecting said steel slab to rough hot-rolling to a reduction ratio of not lower than 85%, at a temperature falling between the $Ar_3$ transformation point of the steel and 950° C. to form sheet bar, then subjecting the sheet bar to lubricative warm-rolling for finishing hot-rolling to a reduction ratio of not lower than 65%, at a temperature falling between 600° C. and the $Ar_3$ transformation point of the steel, while lubricating the sheet bar, to thereby make the sheet bar into a sheet steel having a mean shear strain of not larger than 0.06, then pickling the sheet steel, then pre-annealing the sheet steel at a temperature falling between 700 and 920° C., then cold-rolling the sheet steel to a reduction ratio of not lower than 65%, and thereafter further annealing the sheet steel for recrystallization at a temperature falling between 700 and 920° C., wherein the reduction ratio for the sheet steel in the lubricative warm-rolling step to be effected at a temperature falling between 600° C. and the $Ar_3$ transformation point of the steel is lower than 85% and a reduction ratio for the cold-rolled sheet steel relative to the sheet bar after the rough rolling is lower than 96.6%.

10. The method for producing thick cold-rolled sheet steel as claimed in claim 9, wherein the steel composition further comprises B in an amount of from 0.0001 to 0.01% by weight.

11. The method for producing thick cold-rolled sheet steel as claimed in claim 10, wherein the steel composition further comprises at least one element selected from the group consisting of from 0.001 to 0.05% by weight of Sb, from 0.001 to 0.05% by weight of Bi and from 0.001 to 0.05% by weight by Se.

12. The method for producing thick cold-rolled sheet steel as claimed in claim 9, wherein the steel composition further comprises at least one element selected from the group consisting of from 0.001 to 0.05% by weight of Sb, from 0.001 to 0.05% by weight of Bi and from 0.001 to 0.05% by weight of Se.

* * * * *